US010870066B1

(12) United States Patent
Lawrence

(10) Patent No.: US 10,870,066 B1
(45) Date of Patent: Dec. 22, 2020

(54) ROLLING WHEEL TOY ASSEMBLY

(71) Applicant: Ryan Lawrence, French Lick, IN (US)

(72) Inventor: Ryan Lawrence, French Lick, IN (US)

( * ) Notice: Subject to any disclaimer, the term of this patent is extended or adjusted under 35 U.S.C. 154(b) by 0 days.

(21) Appl. No.: 16/688,637

(22) Filed: Nov. 19, 2019

(51) Int. Cl.
*A63H 33/02* (2006.01)

(52) U.S. Cl.
CPC ..... *A63H 33/02* (2013.01)

(58) Field of Classification Search
CPC ..... A63H 33/02
See application file for complete search history.

(56) References Cited

U.S. PATENT DOCUMENTS 1,574,255 A * 2/1926 Myslinski ..... A63H 33/02 446/453
2,562,522 A * 7/1951 Boyd ..... A63H 33/02 446/453
2,861,389 A * 11/1958 Baker ..... A63H 33/02 446/411
2,960,795 A * 11/1960 Clemente ..... A63H 33/02 446/453
2,970,403 A * 2/1961 Land ..... A63H 33/02 446/453
3,077,699 A * 2/1963 Falciglia ..... A63H 33/02 446/216
3,099,105 A * 7/1963 Martinez ..... A63H 33/02 446/138
3,233,361 A * 2/1966 Conaghan ..... A63H 5/00 446/411
3,785,652 A * 1/1974 Ghovanloo ..... A63H 33/02 273/126 R
3,820,277 A * 6/1974 Beaver ..... A63H 33/02 446/137
3,827,180 A * 8/1974 Phillips, Jr. ..... A63H 33/02 446/450
4,070,792 A * 1/1978 Vuyovich ..... A63H 33/02 446/170
4,091,564 A * 5/1978 Jasinski ..... A63H 33/02 273/126 R
D262,468 S * 12/1981 Jackson ..... D21/457
4,897,069 A * 1/1990 Overturf ..... A63H 33/02 446/219
4,911,675 A * 3/1990 Rogers ..... A63H 33/02 446/267
4,913,677 A * 4/1990 Brasier ..... A63H 33/02 446/453
D325,756 S * 4/1992 Grey ..... D21/457
5,299,970 A 4/1994 Fontaine
5,989,097 A 11/1999 Lebedz
6,366,869 B1 * 4/2002 Germain ..... A63H 33/02 446/453

(Continued)

*Primary Examiner* — Eugene L Kim
*Assistant Examiner* — Alyssa M Hylinski

(57) ABSTRACT

A rolling wheel toy assembly includes a ring that is rollable along a support surface and the ring is comprised of a luminescent material. A pole is provided that can be gripped by a user and a cage is coupled to the pole. The ring extends through the cage such that the cage engages the ring when the ring is rolled along the support surface. In this way the cage can steer the ring. A roller is rotatably coupled to the cage and the roller rotatably engages the ring when the ring is rolled along the support surface. In this way the cage can urge the ring forwardly with a minimum of friction between the cage and the ring.

9 Claims, 7 Drawing Sheets

(56) References Cited

U.S. PATENT DOCUMENTS

| | | | | |
|---|---|---|---|---|
| 7,699,682 | B1 * | 4/2010 | Scott, Sr. | A63H 33/02 446/453 |
| 2007/0087656 | A1 * | 4/2007 | Martinez | A63H 33/02 446/450 |
| 2014/0021684 | A1 * | 1/2014 | Mueller | A63B 67/086 273/412 |
| 2015/0375131 | A1 | 12/2015 | Azari | |
| 2016/0129360 | A1 * | 5/2016 | Penta | A63H 33/02 446/411 |

* cited by examiner

ROLLING WHEEL TOY ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to rolling wheel devices and more particularly pertains to a new rolling wheel device for providing entertainment by rolling a ring with a pole.

(2) Description of Related Art Including Information Disclosed Under 37 CFR 1.97 and 1.98

The prior art relates to rolling wheel devices. The prior art discloses a rod with a sleeve on an end, and a ring that extends through the sleeve. The rotation vector of the ring is limited to the diameter of the sleeve. The prior art additionally discloses a variety of yokes, each with a unique shape, that engage a ring for urging the ring to roll. In each case of yoke disclosure the ring is removable from the yoke. Additionally, the ring frictionally engages the structure of the sleeve or the yoke in each disclosure of the prior art when the ring is rolled.

BRIEF SUMMARY OF THE INVENTION

An embodiment of the disclosure meets the needs presented above by generally comprising a ring is rollable along a support surface and the ring is comprised of a luminescent material. A pole is provided that can be gripped by a user and a cage is coupled to the pole. The ring extends through the cage such that the cage engages the ring when the ring is rolled along the support surface. In this way the cage can steer the ring. A roller is rotatably coupled to the cage and the roller rotatably engages the ring when the ring is rolled along the support surface. In this way the cage can urge the ring forwardly with a minimum of friction between the cage and the ring.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
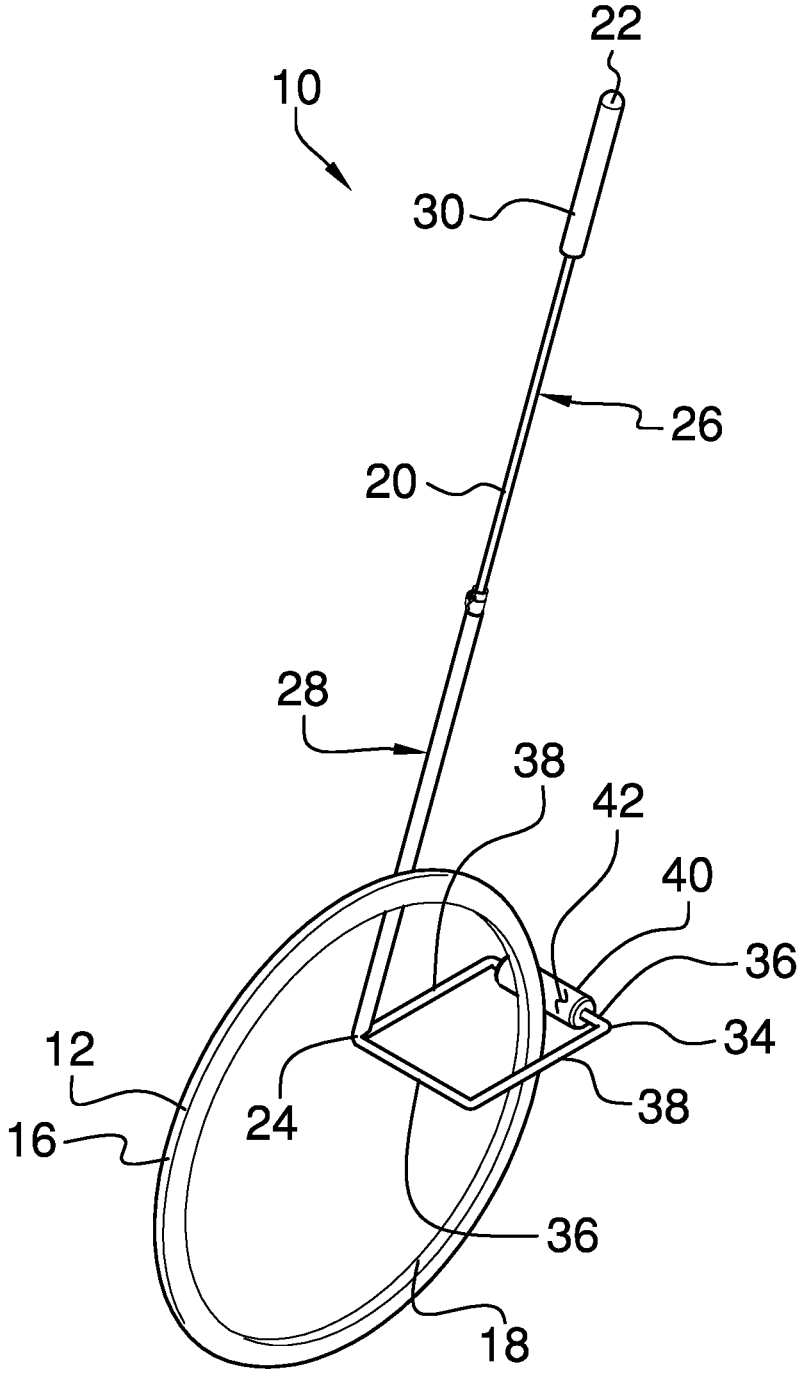
FIG. 1 is a perspective view of a rolling wheel toy assembly according to an embodiment of the disclosure.
Figure 2:
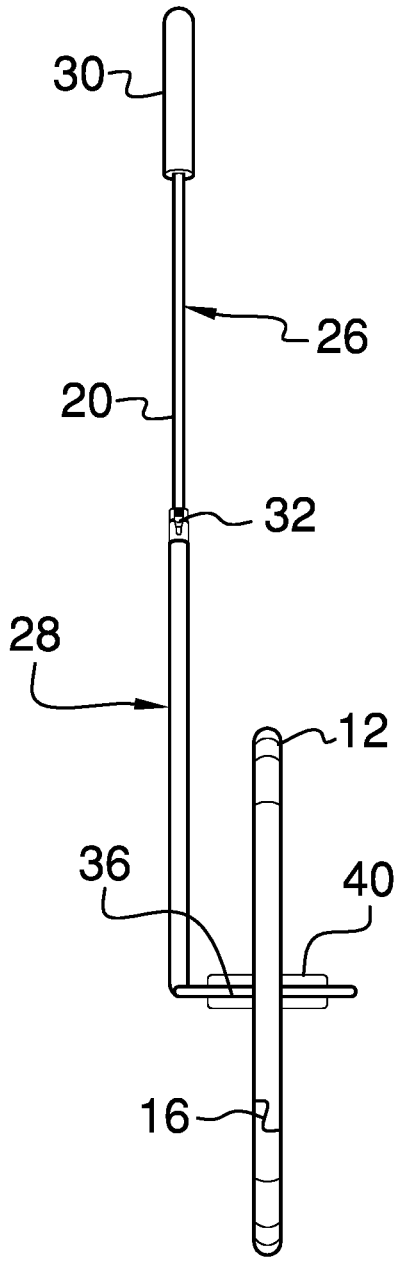
FIG. 2 is a front view of an embodiment of the disclosure.
Figure 3:
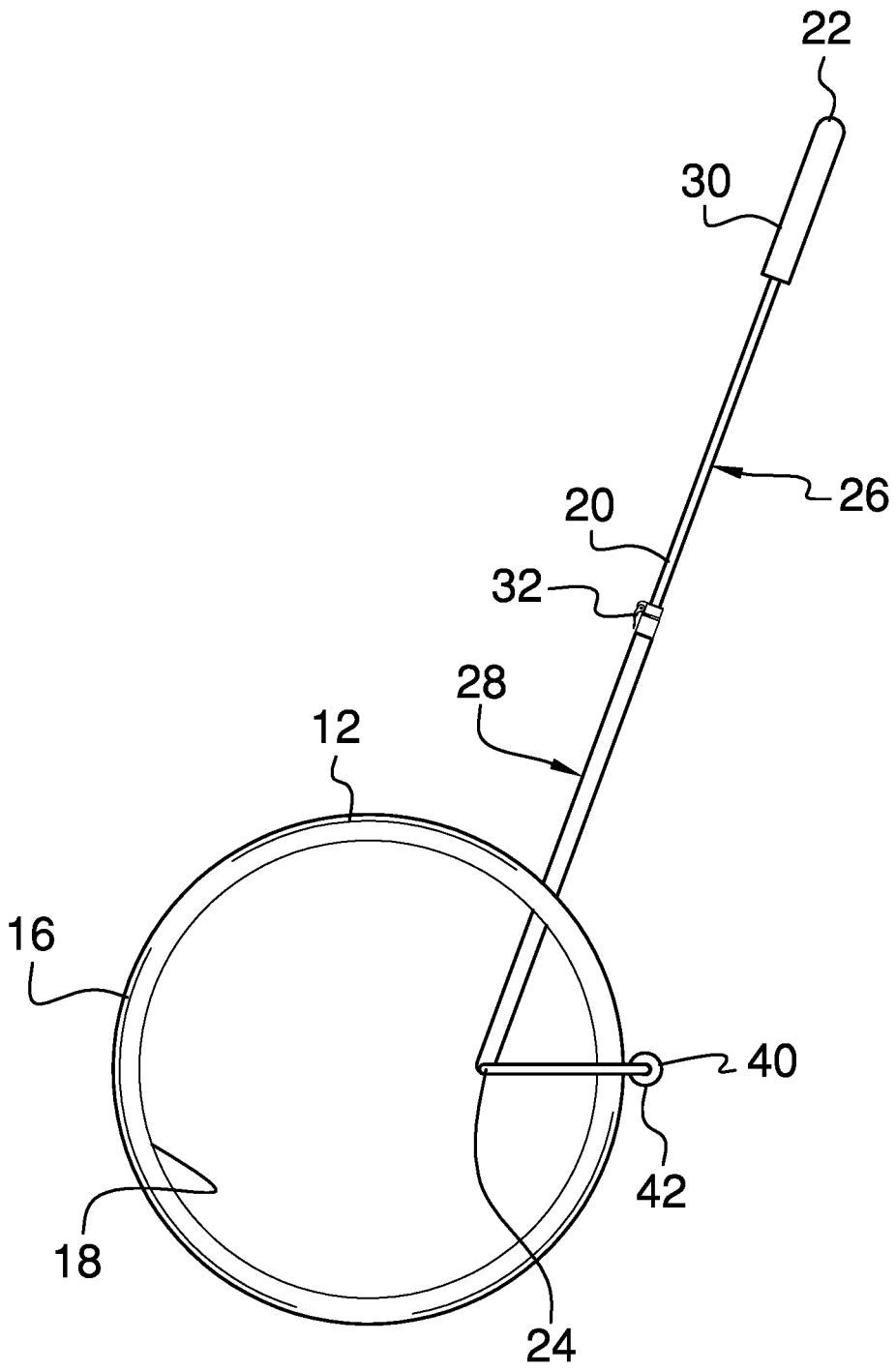
FIG. 3 is a right side view of an embodiment of the disclosure.
Figure 4:
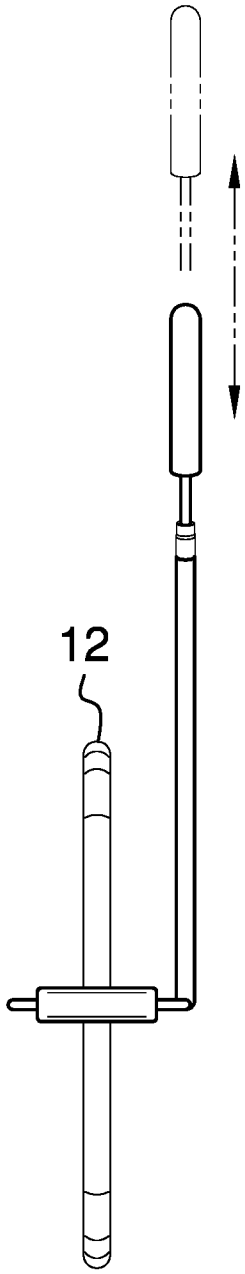
FIG. 4 is a back view of an embodiment of the disclosure.
Figure 5:
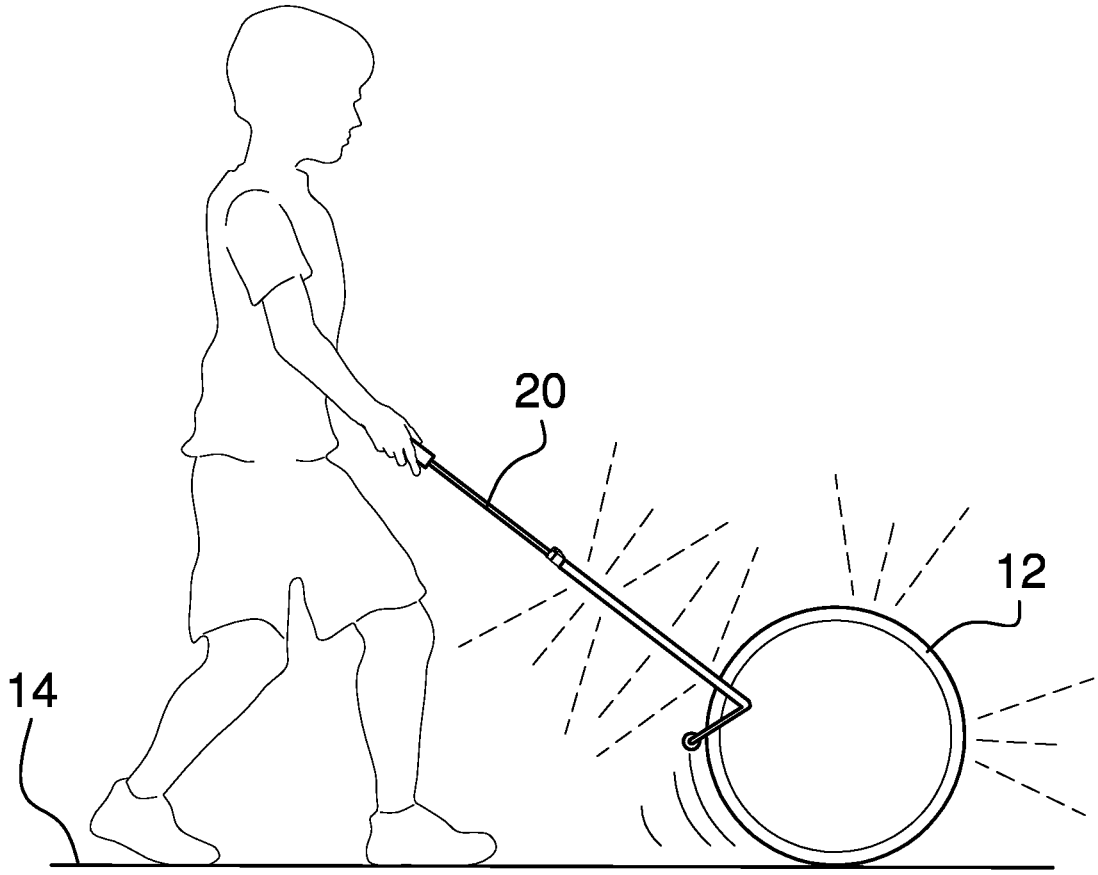
FIG. 5 is a perspective in-use view of an embodiment of the disclosure.

With reference now to the drawings, and in particular to FIGS. 1 through 7 thereof, a new rolling wheel device embodying the principles and concepts of an embodiment of the disclosure and generally designated by the reference numeral 10 will be described.

As best illustrated in FIGS. 1 through 7, the rolling wheel toy assembly 10 generally comprises a ring 12 that is rollable along a support surface 14. The ring 12 is comprised of a luminescent material such that the ring 12 is visible in a darkened environment. The ring 12 has an outwardly facing surface 16 and an inwardly facing surface 18, and the outwardly facing surface 16 engages the support surface 14. The support surface 14 may be the ground, a floor or any other horizontal support surface 14. The ring 12 may have a diameter ranging between approximately 12.0 inches and 18.0 inches.

A pole 20 is provided and the pole 20 is gripped by a user. The pole 20 has a first end 22 and a second end 24, and the pole 20 comprises a first portion 26 that slidably engages a second portion 28 such that the pole 20 has a telescopically adjustable length. A grip 30 is coupled to the pole 20 and the grip 30 extends from the first end 22 toward the second end 24. The grip 30 is comprised of a resiliently compressible material for enhancing gripping the pole 20. An engagement 32 is coupled to the second portion 28 of the pole 20. The engagement 32 frictionally engages the first portion 26 when the engagement 32 is positioned in a tightened condition for retaining the pole 20 at a selected length. The engagement 32 may include, but not be limited to, a screw that engages the first portion 26, a loop that tightens around the first portion 26 or any other mechanical engagement 32.

A cage 34 is provided and the cage 34 is coupled to the pole 20. The ring 12 extends through the cage 34 such that the cage 34 engages the ring 12 when the ring 12 is rolled along the support surface 14 thereby. In this way the cage 34 can steer the ring 12 when the ring 12 is rolled along the support surface 14. The cage 34 comprises a pair of first members 36 that each extends between a pair of second members 38. The second members 38 are spaced apart from each other such that the cage 34 has a rectangular shape.

The second end 24 of the pole 20 is coupled to the cage 34 at a point that is aligned with an intersection between a respective first member 36 and a respective second member 38. Each of the second members 38 extends along a line that is oriented at an acute angle with an axis extending through the first end 22 and the second end 24 of the pole 20. Thus, the pole 20 angles upwardly and rearwardly from the cage 34 when the pole 20 is positioned in a rolling position. In this way the cage 34 can be steered by the user when the user grips the pole 20. Additionally, each of the first members 36 and each of the second members 38 lie on a horizontal plane when the pole 20 is positioned in the rolling position. Moreover, the ring 12 extends through a space between each of the first members 36 and the second members 38 such that the ring 12 cannot be removed from the cage 34.

A roller 40 is provided and the roller 40 is rotatably coupled to the cage 34. The roller 40 rotatably engages the ring 12 when the ring 12 is rolled along the support surface 14. In this way the cage 34 can urge the ring 12 forwardly with a minimum of friction between the cage 34 and the ring 12. The roller 40 extends along a respective one of the second members 38 that is spaced furthest from the pole 20. The roller 40 has an outer surface 42 and the outer surface 42 engages the outwardly facing surface 16 of the ring 12 when the pole 20 is moved forwardly. Conversely, a respective one of the second members 38 that is positioned closest to the pole 20 engages the inwardly facing surface 18 of the ring 12 when the pole 20 is carried thereby inhibiting the ring 12 from disengaging the cage 34.

Figure 6:
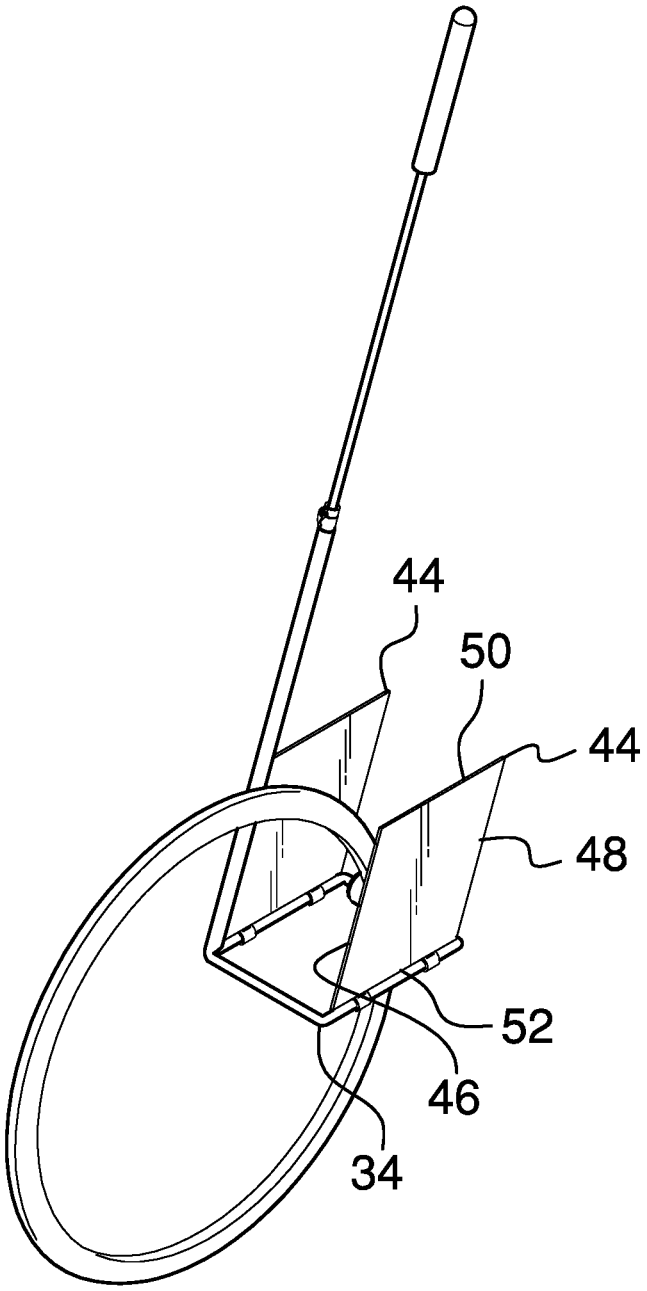
FIG. 6 is a perspective view of an embodiment of the disclosure showing panels installed on a cage.
Figure 7:
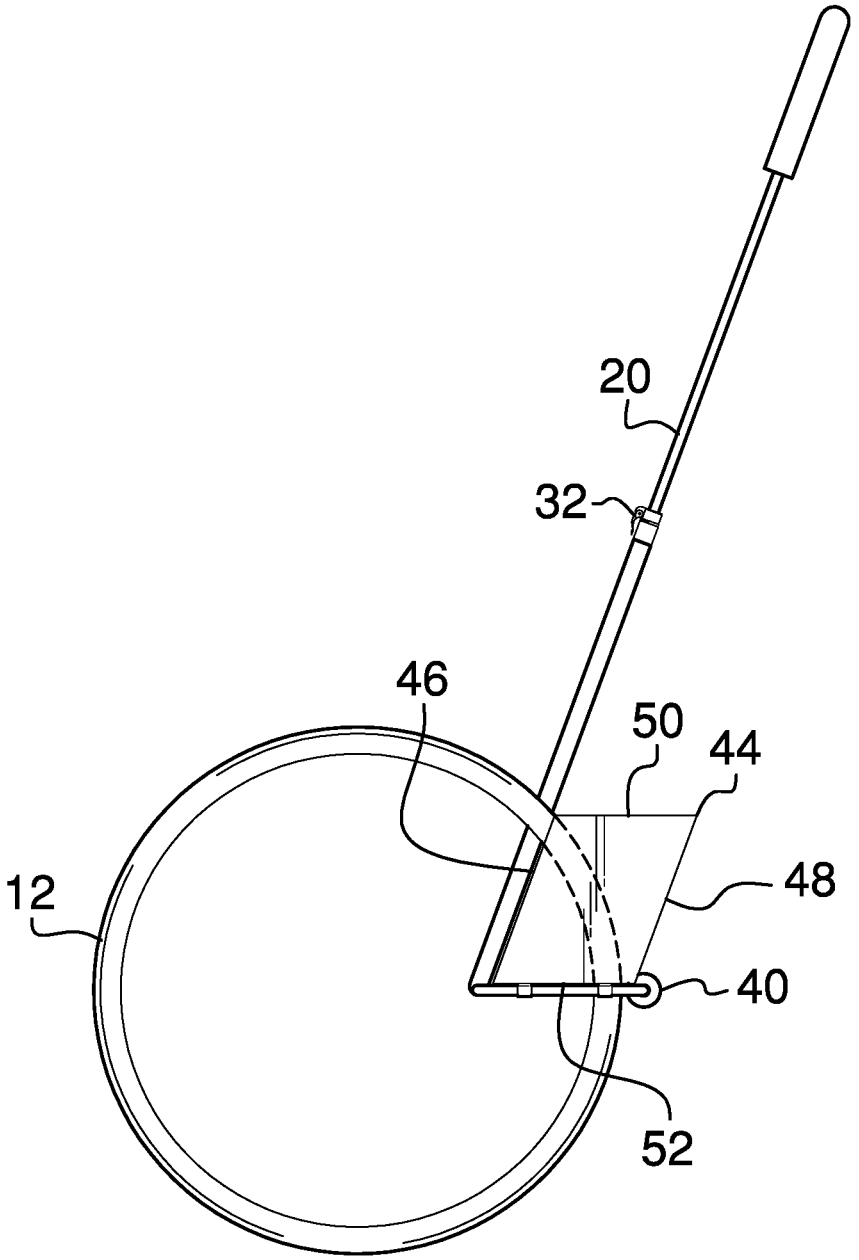
FIG. 7 is a right side view of an embodiment of the disclosure showing panels installed on a cage.

As is most clearly shown in FIGS. 6 and 7, a pair of panels 44 is provided and each of the panels 44 can be removably attached to a respective one of the second members 38 of the cage 34. Each of the panels 34 is vertically oriented on the respective second member 38. In this way the panels 44 offer additional stabilization for the ring 12 when the ring 12 is being rolled along the ground. Thus, a user with limited physical skill, or experience with the toy, can enjoy rolling the ring 12 along the ground. Each of the panels 44 has a front edge 46, a back edge 48, a top edge 50 and a bottom edge 52. The front edge 46 and the back edge 48 of each panel angles rearwardly between the bottom edge 52 and the top edge 50. Thus, each of the panels 44 has a rhombus shape.

In use, the pole 20 is adjusted to a desired length and the grip 30 on the pole 20 is gripped while directing the pole 20 downwardly toward the support surface 14. Thus, the ring 12 can roll along the support surface 14 while the user walks or runs with while holding the pole 20. The roller 40 rolls against the ring 12 while the user walks to roll the ring 12 along the support surface 14. Moreover, the cage 34 inhibits the ring 12 from tipping over thereby enhancing the user's pleasure while rolling the ring 12. The roller 40 reduces friction between the ring 12 and the cage 34 while the ring 12 is rolling along the support surface 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A rolling wheel toy assembly being configured to roll a wheel along a support surface with a guide pole for entertainment purposes, said assembly comprising:

a ring being rollable along a support surface, said ring being comprised of a luminescent material wherein said ring is configured to be visible in a darkened environment;

a pole for being gripped by a user;

a cage being coupled to said pole, said cage having said ring extending therethrough such that said cage engages said ring when said ring is rolled along the support surface thereby facilitating said cage to steer said ring;

a roller being rotatably coupled to said cage, said roller rotatably engaging said ring when said ring is rolled along the support surface thereby facilitating said cage to urge said ring forwardly with a minimum of friction between said cage and said ring; and a pair of panels, each of said panels being removably coupled to said cage such that said panels are positioned parallel to each other on opposite sides of said cage and perpendicular to said roller.

2. The assembly according to claim 1, wherein said pole has a first end and a second end, said pole comprising a first portion that slidably engages a second portion such that said pole has a telescopically adjustable length.

3. The assembly according to claim 2, further comprising a grip being coupled to said pole, said grip extending from said first end toward said second end, said grip being comprised of a resiliently compressible material for enhancing gripping said pole.

4. The assembly according to claim 3, further comprising an engagement being coupled to said second portion of said pole, said engagement frictionally engaging said first portion when said engagement is positioned in a tightened condition for retaining said pole at a selected length.

5. The assembly according to claim 2, wherein said cage comprises a pair of first members each extending between a pair of second members, said second members being spaced apart from each other such that said cage has a rectangular shape, said second end of said pole being coupled to said cage at a point aligned with an intersection between a respective first member and a respective second member.

6. The assembly according to claim 5, wherein each of said second members extends along a line being oriented at an acute angle with an axis extending through said first end and said second end of said pole such that said pole angles upwardly and rearwardly from said cage when said pole is positioned in a rolling position wherein said cage is configured to be steered by the user when the user grips said pole.

7. The assembly according to claim 6, wherein each of said first members and each of said second members lying on a horizontal plane when said pole is positioned in said rolling position, said ring extending through a space between each of said first members and said second members.

8. The assembly according to claim 7, wherein:

said ring has an outwardly facing surface and an inwardly facing surface, said outwardly facing surface engaging the support surface; and said roller extends along a respective one of said first members that is spaced furthest from said pole, said roller having an outer surface, said outer surface engaging said outwardly facing surface of said ring when said pole is moved forwardly, a respective one of said first members being positioned closest to said pole engaging said inwardly facing surface of said ring when said pole is carried thereby inhibiting said ring from disengaging said cage.

9. A rolling wheel toy assembly being configured to roll a wheel along a support surface with a guide pole for entertainment purposes, said assembly comprising:

a ring being rollable along a support surface, said ring being comprised of a luminescent material wherein said ring is configured to be visible in a darkened environment, said ring having an outwardly facing surface and an inwardly facing surface, said outwardly facing surface engaging the support surface;

a pole for being gripped by a user, said pole having a first end and a second end, said pole comprising a first portion that slidably engages a second portion such that said pole has a telescopically adjustable length;

a grip being coupled to said pole, said grip extending from said first end toward said second end, said grip being comprised of a resiliently compressible material for enhancing gripping said pole;

an engagement being coupled to said second portion of said pole, said engagement frictionally engaging said first portion when said engagement is positioned in a tightened condition for retaining said pole at a selected length;

a cage being coupled to said pole, said cage having said ring extending therethrough such that said cage engages said ring when said ring is rolled along the support surface thereby facilitating said cage to steer said ring, said cage comprising a pair of first members each extending between a pair of second members, said second members being spaced apart from each other such that said cage has a rectangular shape, said second end of said pole being coupled to said cage at a point aligned with an intersection between a respective first member and a respective second member, each of said second members extending along a line being oriented at an acute angle with an axis extending through said first end and said second end of said pole such that said pole angles upwardly and rearwardly from said cage when said pole is positioned in a rolling position wherein said cage is configured to be steered by the user when the user grips said pole, each of said first members and each of said second members lying on a horizontal plane when said pole is positioned in said rolling position, said ring extending through a space between each of said first members and said second members;

a roller being rotatably coupled to said cage, said roller rotatably engaging said ring when said ring is rolled along the support surface thereby facilitating said cage to urge said ring forwardly with a minimum of friction between said cage and said ring, said roller extending along a respective one of said first members that is spaced furthest from said pole, said roller having an outer surface, said outer surface engaging said outwardly facing surface of said ring when said pole is moved forwardly, a respective one of said first members being positioned closest to said pole engaging said inwardly facing surface of said ring when said pole is carried thereby inhibiting said ring from disengaging said cage; and a pair of panels, each of said panels being removably coupled to said cage such that said panels are positioned parallel to each other on opposite sides of said cage and perpendicular to said roller.

* * * * *